United States Patent [19]

Lawson

[11] Patent Number: 5,050,357

[45] Date of Patent: Sep. 24, 1991

[54] SHEET ROOFING ORGANIZATION

[76] Inventor: Gregory E. Lawson, 680 Grovewood Dr., Gretna, La. 70056

[21] Appl. No.: 597,559

[22] Filed: Oct. 15, 1990

[51] Int. Cl.[5] ..... E04D 1/26

[52] U.S. Cl. ..... 52/314; 52/420; 52/520; 52/543; 52/391

[58] Field of Search ..... 52/314, 420, 391, 390, 52/518, 520, 543

[56] References Cited

FOREIGN PATENT DOCUMENTS 686819 5/1964 Canada ..... 52/314

OTHER PUBLICATIONS

Popular Mechanics, pp. 180–183, Oct. 1957.

*Primary Examiner*—John E. Murtagh

*Attorney, Agent, or Firm*—Leon Gilden

[57] ABSTRACT

A sheet-like member including a plurality of rows of patterned shingle construction defined by shingle face members separated by associated grooves defined within a forward surface of the sheet, with a rear surface of the sheet including spaced parallel adhesive strips. A modification of the invention includes engagement ribs directed between the adhesive strips to enhance positioning and gripping of a roof surface during securement of the organization thereon.

2 Claims, 3 Drawing Sheets

PRIOR ART

SHEET ROOFING ORGANIZATION

BACKGROUND OF THE INVENTION

1. Field of the Invention

The field of invention relates to roofing and covering materials, and more particularly pertains to a new and improved sheet roofing organization defined by a flexible sheet member for securement to a roof surface.

1. Description of the Prior Art

Various sheet-like covering materials have been utilized in the prior art for securement to roof structure, and examples are provided of sheet-like materials for that purpose. Such examples include U.S. Pat. No. 3,640,044 to Watts wherein sheet-like members of shingles utilize staples directed therethrough for securement of the shingles to an associated roof structure.

U.S. Pat. No. 2,335,493 to Drinkall sets forth a further example of a sheet-like shingle structure utilizing shingle structure defined by intersecting groove structure.

U.S. Pat. No. 2,182,526 to Rumer sets forth asphalt-type roofing utilizing clips to secure various sheets of structure together.

U.S. Pat. No. 2,348,223 sets forth an ornamental granular type shingle of conventional configuration.

U.S. Pat. No. 2,253,652 to Ritter sets forth a further shingle structure and a method of its production.

As such, it may be appreciated that there continues to be a need for a new and improved sheet roofing organization as set forth in the instant invention which addresses both the problems of ease of use as well as effectiveness in construction and in this respect, the present invention substantially fulfills this need.

SUMMARY OF THE INVENTION

In view of the foregoing disadvantages inherent in the known types of shingle construction now present in the prior art, the present invention provides a sheet roofing organization wherein the same utilizes a flexible sheet capable of mounting within a roll utilizing adhesive members to permit securement of the organization to an underlying roof. As such, the general purpose of the present invention, which will be described subsequently in greater detail, is to provide a new and improved sheet roofing organization which has all the advantages of the prior art roofing constructions and none of the disadvantages.

To attain this, the present invention provides a sheet-like member including a plularity of rows of patterned shingle construction defined by shingle face members separated by associated grooves defined within a forward surface of the sheet, with a rear surface of the sheet including spaced parallel adhesive strips. A modification of the invention includes engagement ribs directed between the adhesive strips to enhance positioning and gripping of a roof surface during securement of the organization thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sheet roofing organization which has all the advantages of the prior art roofing constructions and none of the disadvantages.

It is another object of the present invention to provide a new and improved sheet roofing organization which may be easily and efficiently manufactured and marketed.

It is a further object of the present invention to provide a new and improved sheet roofing organization which is of a durable and reliable construction.

An even further object of the present invention is to provide a new and improved sheet roofing organization which is susceptible of a low cost of manufacture with regard to both materials and labor, and which accordingly is then susceptible of low prices of sale to the consuming public, thereby making such sheet roofing organizations economically available to the buying public.

Still yet another object of the present invention is to provide a new and improved sheet roofing organization which provides in the apparatuses and methods of the prior art some of the advantages thereof, while simultaneously overcoming some of the disadvantages normally associated therewith.

Still another object of the present invention is to provide a new and improved sheet roofing organization wherein the same sets forth convenience of construction in application to an underlying roof organization permitting conformity and ease of mounting thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
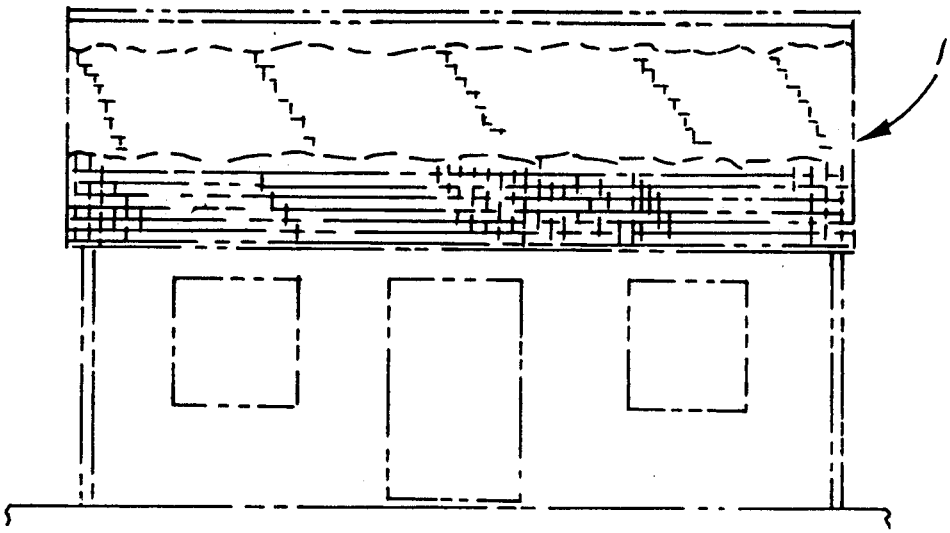
FIG. 1 is an orthographic view, taken in elevation of a prior art shingle panel construction.

With reference now to the drawings, and in particular to FIGS. 1 to 7 thereof, a new and improved sheet roofing organization embodying the principles and concepts of the present invention and generally designated by the reference numerals 10, 10*a*, and 10*b* will be described.

Figure 2:
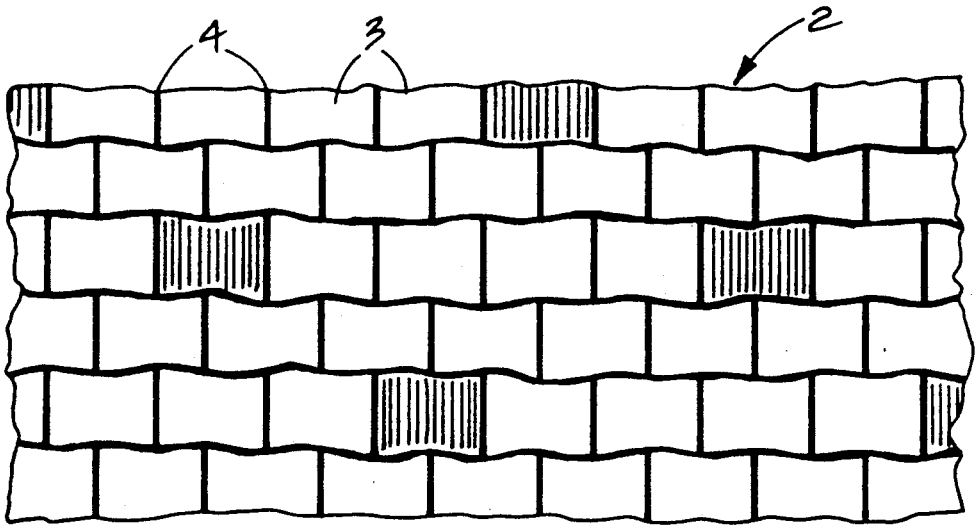
PRIOR ART FIG 2
FIG. 2 is an orthographic view, taken in elevation of a further example of a prior art shingle panel construction.

FIG. 1 illustrates a prior art shingle construction as set forth in U.S. Pat. No. 3,640,044 with a single panel of shingles mounted to a roof member utilizing staples and the like. FIG. 2 illustrates a further prior art sheet covering material, as set forth in U.S. Pat. No. 2,335,493, wherein shingle members 3 formed upon a sheet member defined with intersecting grooves 4 to define the panel organization 2 for mounting to a roof structure.

Figure 3A:
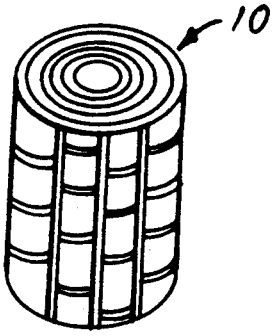
FIG. 3*a* is an isometric illustration of the instant invention in a rolled configuration.
Figure 3:
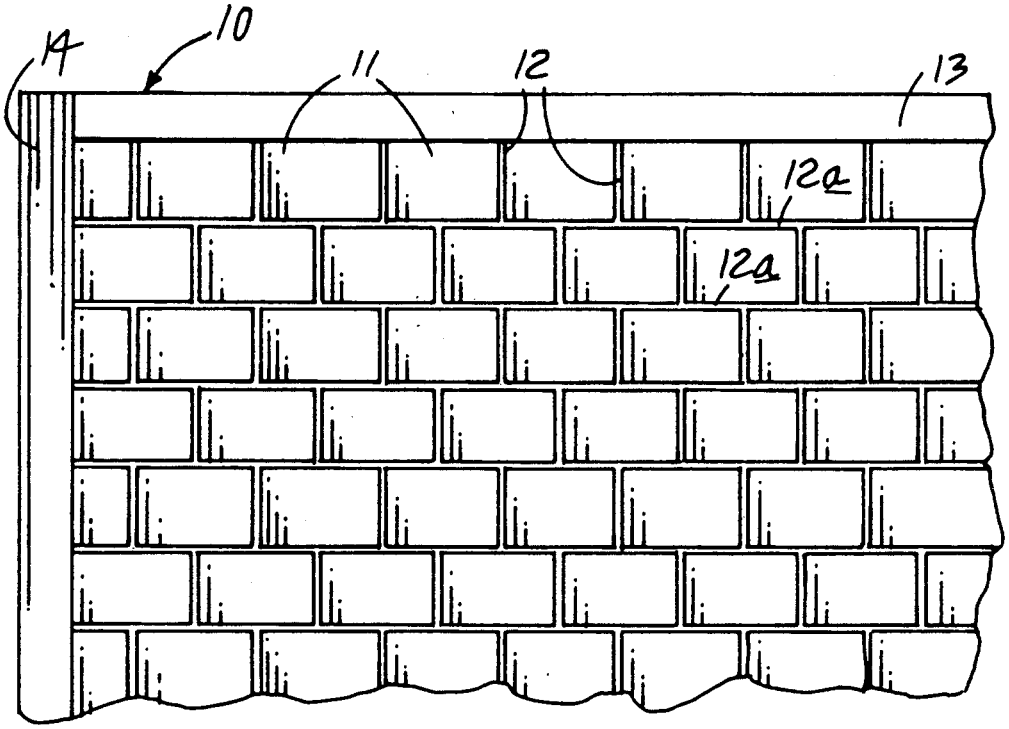
FIG. 3 is an orthographic view, taken in elevation, of the instant invention.
Figure 4:
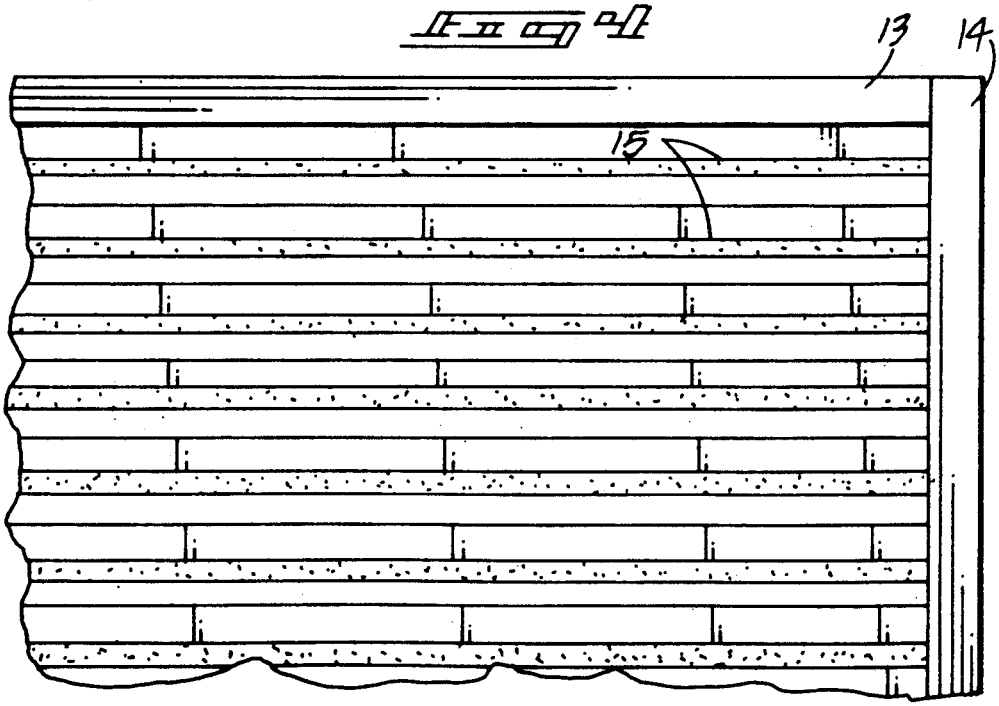
FIG. 4 is an orthographic rear view, taken in elevation, of the instant invention.
Figure 5:
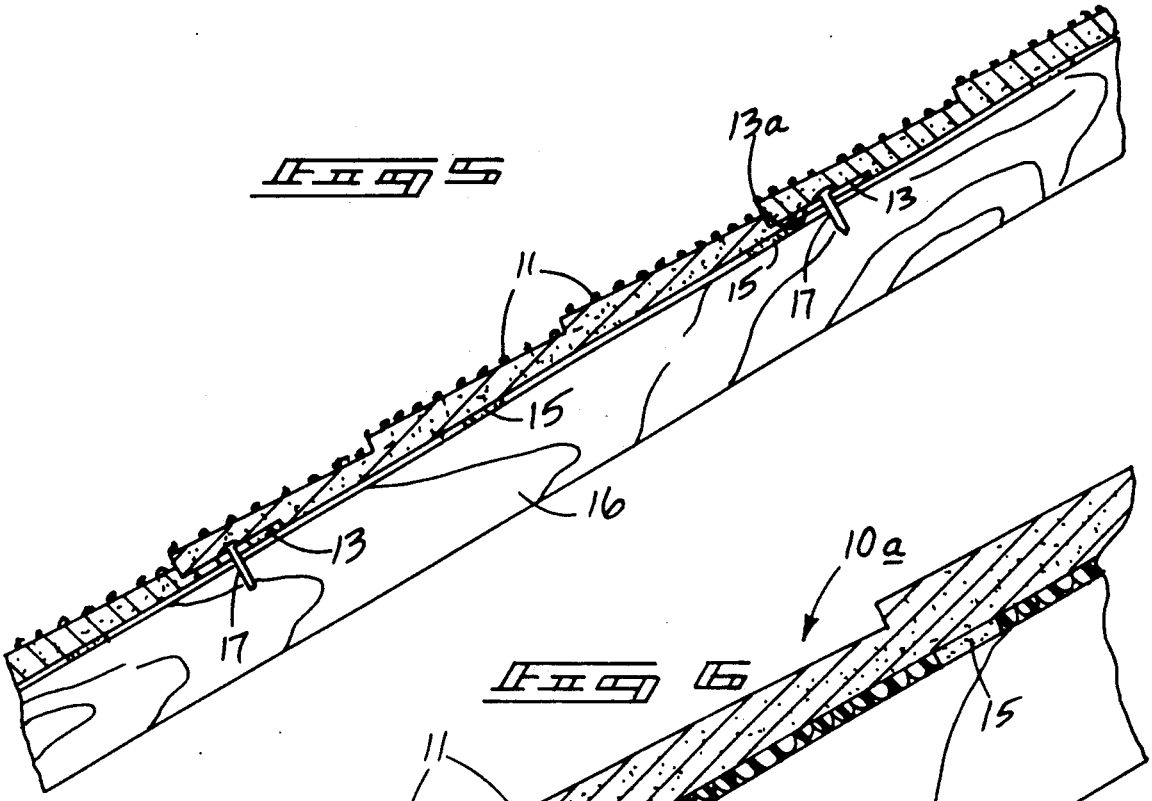
FIG. 5 is an orthographic cross-sectional configuration of the instant invention mounted to a roof construction.
Figure 6:
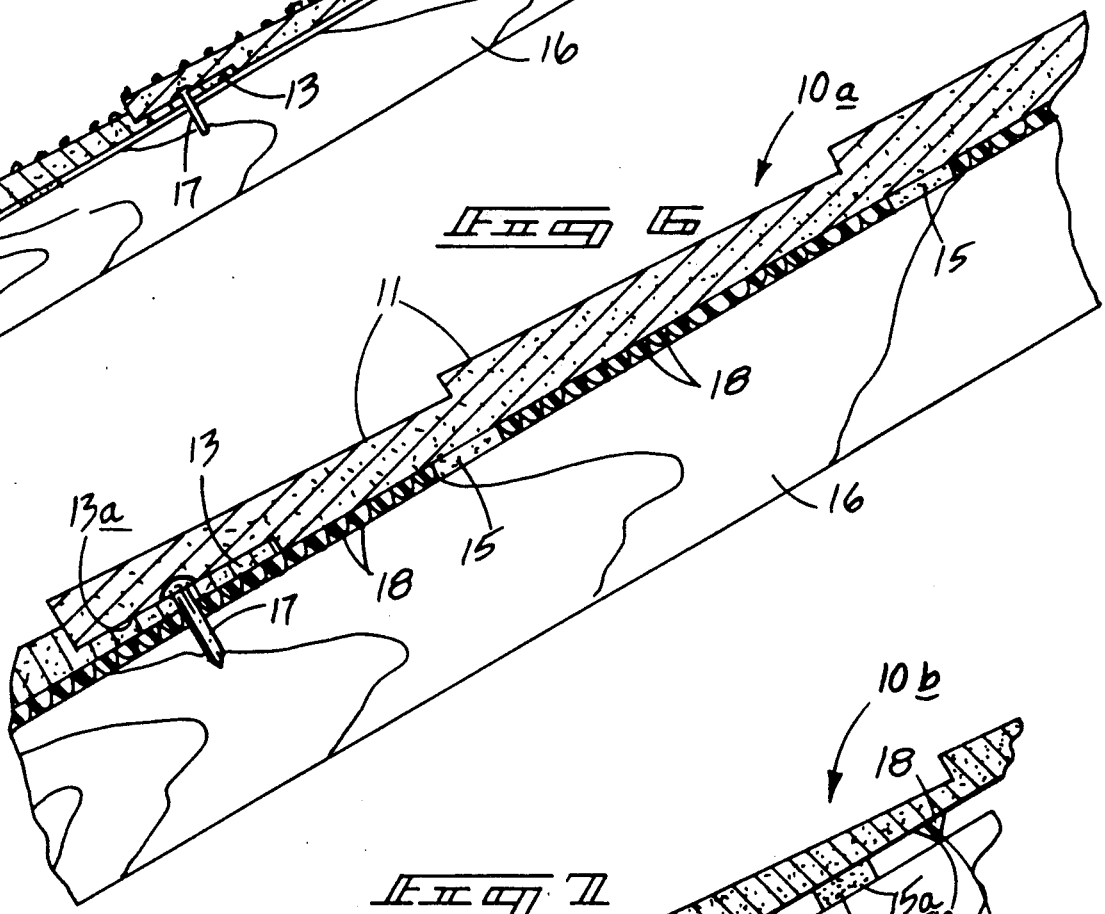
FIG. 6 is a modification of the instant invention mounted to a roof construction in cross-sectional illustration.
Figure 7:
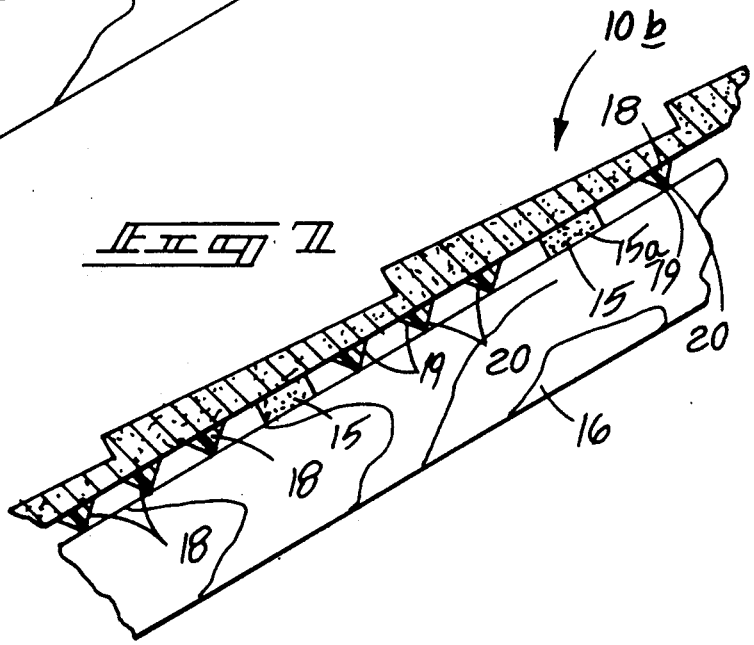
FIG. 7 is a further modification of the instant invention taken in cross-section of the organization mounted to a roof member.

More specifically, the sheet roofing organization 10 of the instant invention essentially comprises a sheet-like member that may be mounted in a rolled configuration, as illustrated in FIG. 3*a*, for positioning and securement to overlie a roof structure, wherein the sheet-like member includes a matrix of shingle face members 11 arranged in an offset parallel relationship, as illustrated in FIG. 3, typically utilizing four rows of such face members 11, but may incorporate a greater number of such rows, as illustrated in FIG. 3, dependent upon relative size of each of the face members. Vertical grooves 12 intersect horizontal grooves 12*a* defined between the face members on the sheet-like member. A horizontal nailing flange 13 is mounted coextensively to an upper edge of the sheet-like member, with a vertical nailing flange 14 formed to and coextensive with a left side portion of the sheet-like member to receive nail members therethrough to position and secure the sheet as it is unrolled from its rolled like configuration, as illustrated in FIG. 3*a*. Wherein the grooves 12 and 12*a*, as well as the face members 11, are formed to the forward face of the sheet-like member, spaced parallel horizontal adhesive strips 15 are mounted to the rear surface of the sheet-like member and extend outwardly thereof for positioning and securement of the sheet-like member to an underlying roof member 16, in a manner as illustrated in FIGS. 5–7. As illustrated in FIGS. 5 and 6 for example, the nail fasteners 17 secure the upper edge of each sheet-like member relative to the roof panel to receive in an overlapped relationship a further sheet-like member to span and cover a roof panel. Accordingly as illustrated, the flanges 13 and 14 for receiving the nail fasteners are recessed relative to the upper surface of the face members 11 to permit reception of an upper or adjacent sheet-like member, as illustrated in FIG. 5, with each upper member lower edge including a recessed groove 13*a* to receive each upper horizontal nailing flange 13, wherein each recessed groove 13*a* is defined by a width substantially equal to the defined width of each horizontal nailing flange 13, as illustrated in FIGS. 5 and 6 for example.

FIG. 6 illustrates the use of parallel rows of resilient engagement ribs 18 coextensively directed through the bottom surface of the sheet-like member coextensively between the spaced adhesive strips 15 to permit frictional engagement and securement of the sheet-like member to an associated roof panel 16 during positioning of the sheet-like member thereon to minimize undesired repositioning of the sheet-like member during its mounting upon an associated roof panel. The modification 10*a*, as illustrated in FIG. 6, is utilized to enhance ease of mounting of each sheet-like member onto an associated roof panel.

FIG. 7 illustrates a further modification 10*b*, wherein parallel rows of resilient engagement ribs 18 are also provided, but are each provided with a metal covering laminate 19 defining a piercing tip 20 aligned with an outer surface 15*a* of each adhesive strip, wherein the piercing strips 20 enhance engagement and securement of the sheet-like panel 10*b* into the underlying roof panel 16 during application of the panel 16 thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sheet roofing organization defining an elongate, flexible panel, wherein the panel includes a forward surface and a rear surface, the forward surface including plural rows of face members extending beyond the forward surface, wherein each row of face members is offset relative to adjacent rows, and a plurality of spaced parallel adhesive strips mounted to the rear surface for adhesive securement to an underlying roof panel, and including a horizontal nailing flange mounted coextensively to an upper edge of the sheet-like member, with the horizontal nailing flange including a horizontal nailing flange top surface recessed below a face member top surface defined by the face members, and the sheet-like member including an elongate bottom edge, and a bottom edge recess groove directed into the rear surface adjacent the bottom edge, wherein the recessed groove is defined by a recessed groove width and wherein the horizontal nailing flange is defined by a horizontal nailing flange width, wherein the horizontal nailing flange width is equal to the recess groove width, and including a vertical nailing flange formed coextensively to a left edge of the sheet-like member, and including parallel rows of resilient engagement ribs mounted coextensively to the rear surface of the sheet-like member between the adhesive strips.

2. A sheet roofing organization as set forth in claim 1 wherein the engagement ribs include a metal covering laminate, and each metal covering laminate includes a piercing tip formed to each outermost edge of each engagement rib to enhance engagement with a roof panel, and the piercing tips are aligned with each outer surface of each adhesive strip.

* * * * *